United States Patent [19]

Perschka

[11] Patent Number: 4,529,138

[45] Date of Patent: Jul. 16, 1985

[54] STRIP CORE WINDER FOR CORE-COIL ASSEMBLY

[75] Inventor: Dale O. Perschka, Nicholson, Ga.

[73] Assignee: Westinghouse Electric Corp., Pittsburgh, Pa.

[21] Appl. No.: 527,601

[22] Filed: Aug. 29, 1983

[51] Int. Cl.[3] ..... B65H 81/02

[52] U.S. Cl. ..... 242/4 R; 29/605

[58] Field of Search ..... 242/4 R, 7.02; 29/605

[56] References Cited

U.S. PATENT DOCUMENTS

| | | | |
|---|---|---|---|
| 2,160,589 | 5/1939 | Granfield | 242/4 R |
| 2,260,011 | 10/1941 | Driftmeyer | 242/4 R |
| 3,792,241 | 2/1974 | Sullivan | 242/4 R X |
| 3,925,885 | 12/1975 | Smith | 29/605 |
| 3,985,310 | 10/1976 | Kent et al. | 242/4 R |
| 4,269,366 | 5/1981 | Lindenmeyer | 242/4 R |

FOREIGN PATENT DOCUMENTS

| | | | |
|---|---|---|---|
| 68415 | 1/1983 | European Pat. Off. | 242/4 R |
| 45-2501 | 1/1970 | Japan | 242/4 R |
| 410187 | 10/1966 | Switzerland | 242/4 R |

OTHER PUBLICATIONS

Core Winding Machine, IBM Technical Disclosure Bulletin, vol. 5, No. 9, Feb. 1963, p. 9.

*Primary Examiner*—Stuart S. Levy
*Assistant Examiner*—Joseph J. Hail, III
*Attorney, Agent, or Firm*—Donald R. Lackey

[57] ABSTRACT

A strip coil winder for making a core-coil assembly characterized by feed rolls for feeding a conductive strip through a core window, drive rolls for receiving the strip on the other side of the window and re-directing the strip to the feed rolls, and winding rolls for wrapping the strip tightly in place on the core to form a helical winding.

2 Claims, 10 Drawing Figures

STRIP CORE WINDER FOR CORE-COIL ASSEMBLY

BACKGROUND OF THE INVENTION

1. Field of the Invention

This invention relates to apparatus for winding a strip conductor on a jointless core and, more particularly, it pertains to means for winding of the strip conductor tightly against the core with a plurality of helical turns of the conductor.

2. Description of the Prior Art

Presently, methods of winding a coil around a jointless core require either a space between the inner diameter of the coil and core, such as in a split gear type wound coil, or a toroidal wound core having a large center bore. Where, however, the core is comprised of wound amorphous metal, a problem occurs. The normal thickness of amorphous metal is about 1 mil, which increases the number of laminations required to make a core, and increases the difficulty of forming a joint in the core. For this reason, the preferred method of making a core-coil assembly is by winding the coil around a jointless core.

SUMMARY OF THE INVENTION

In accordance with this invention apparatus for winding strip conductor to construct a coil around a jointless core for making a core-coil assembly is provided which comprises means for dispensing conductive strip through feed rolls into a window of a core having entrance and exit sides for the strip, guide means for directing the lead end portion of the strip from the exit side to the feed rolls at the entrance side for refeeding through the window, drive roll means at the exit side of the window for advancing the strip along the guide means, means for securing the tail end portion of the strip to the core, holding means at the exit side of the window for holding the strip and for wrapping the strip tautly around the core to the entrance side, and means for retracting and extending the feed rolls, drive rolls, and holding means in a synchronized pattern of operation to enable engagement and disengagement of the strip for providing a plurality of helically wound turns of strip.

The invention also comprises a method for winding strip conductor to construct a coil around a jointless core for making a core-coil assembly which comprises the step of providing a jointless core on a table, the core having a window with an axis parallel to the table plane, providing a dispenser of conductive strip, paying out a lead end of the strip through feed rolls, the core window, and drive rolls a desired length of strip, shearing the strip to the desired length to form a tail end thereof, securing the tail end to the core, feeding the lead end through the feed rolls and through the window, retracing the drive rolls from the strip, grasping the strip leading from the window by winding rolls and wrapping it around and against the core by moving the winding rolls around one-half portion of the core from the exit side to the entrance side of the window, and redirecting the lead end of the strip through the core window.

The advantage of the device of this invention is that it facilitates the winding of metal strip having a small gauge to form a core-coil assembly.

DESCRIPTION OF THE PREFERRED EMBODIMENTS

Figure 1:
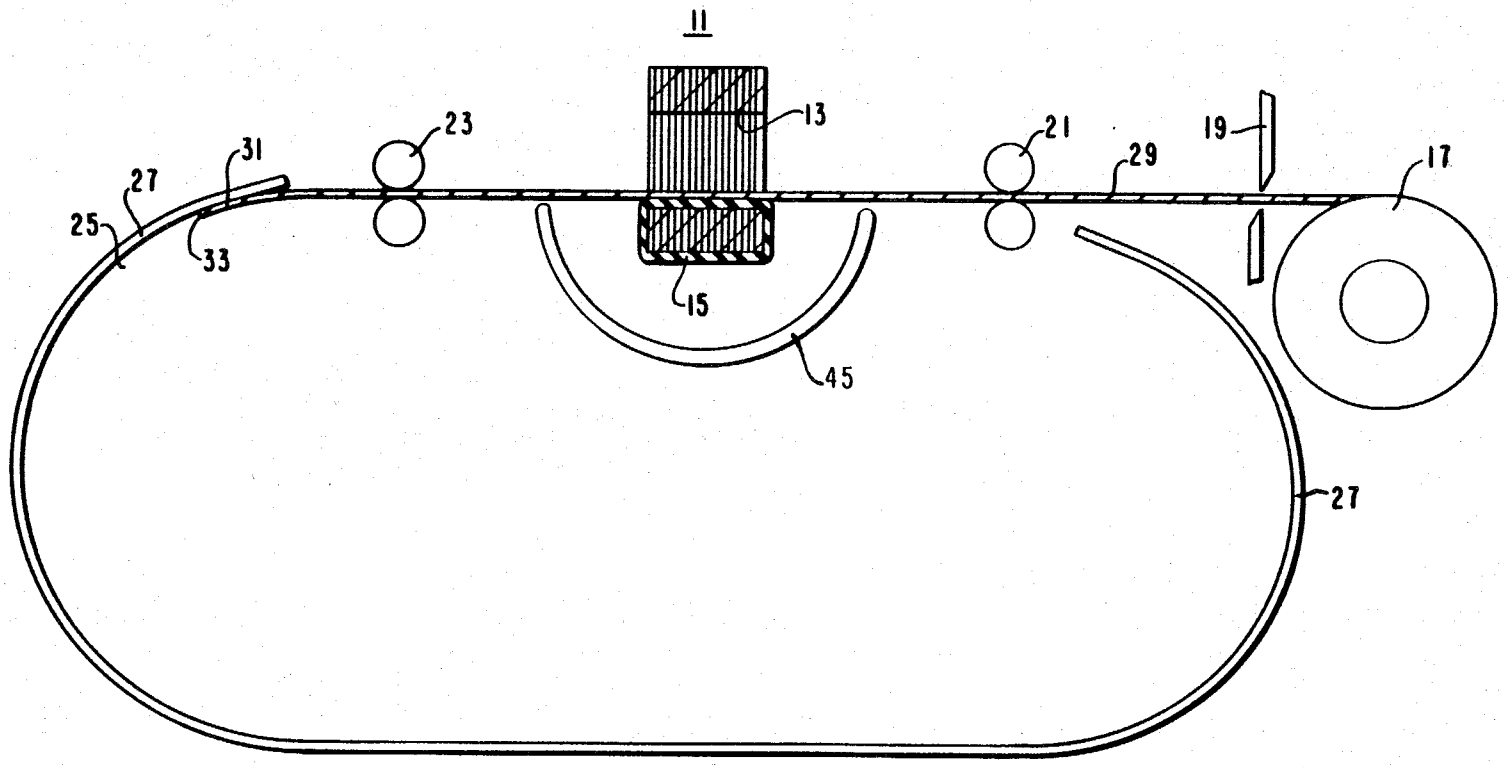
FIGS. 1–8 are schematic views of the consecutive steps required for winding a strip coil on one side of a core leg in accordance with this invention.

A core is generally indicated at 11 in FIG. 1 and is comprised of thin stampings or laminations of a suitable material, such as silicon steel or amorphous metal, which are assembled to provide an opening or window 13. As shown in the drawing, the core 11 is preliminarily provided with a high-voltage winding 15 so that the coil or winding applied by the apparatus and method set forth hereinbelow is a low-voltage winding applied around the high-voltage winding 15.

The apparatus of this invention comprises a supply coil or reel 17, shears 19, feed rolls 21, pinch or drive rolls 23, and a table 25 having a peripheral flange 27. A strip 29 of a suitable conductive metal, such as aluminum or copper, is payed off the reel 17 through the open shears 19, the feed rolls 21, the core window 13, and the drive rolls 23.

The first step (FIG. 1) of the method involved the feeding of the strip 29 through the window 13 of the core as shown so that a lead end 31 of the strip is positioned at a location 33.

Figure 2:
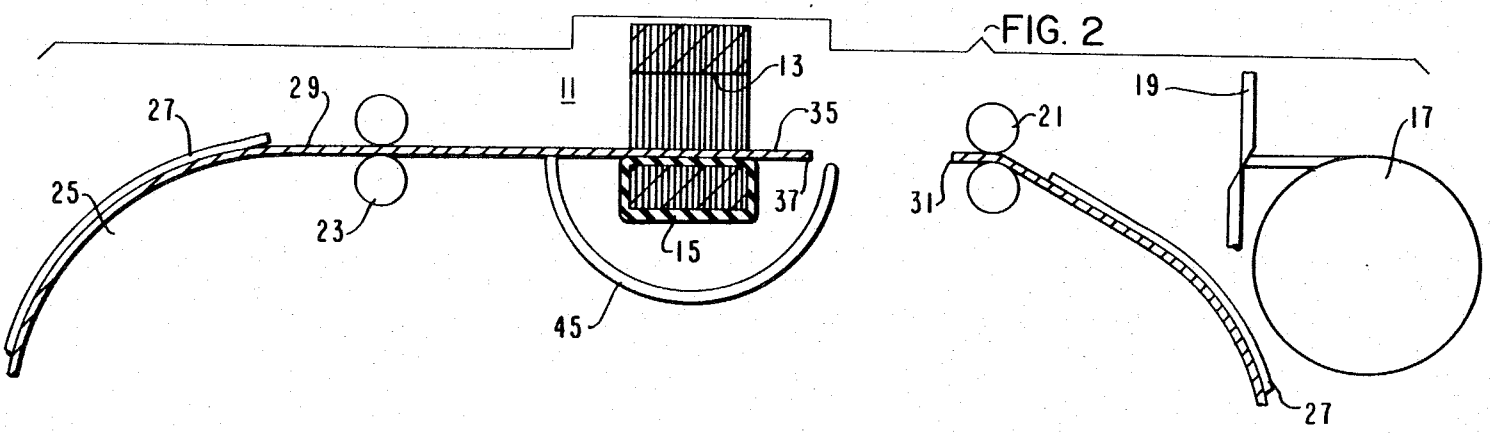

In FIG. 2 the strip 29 is driven counterclockwise around the table 25 where it is retained by the guide means or flange 27 until a predetermined length of strip is payed out from the reel 17 where it is cut off at shears 19 to form the tail end 35, whereafter the strip is moved by the drive rolls 23 until the tail end 35 reaches a location 37 just beyond the feed rolls 21.

Figure 3:
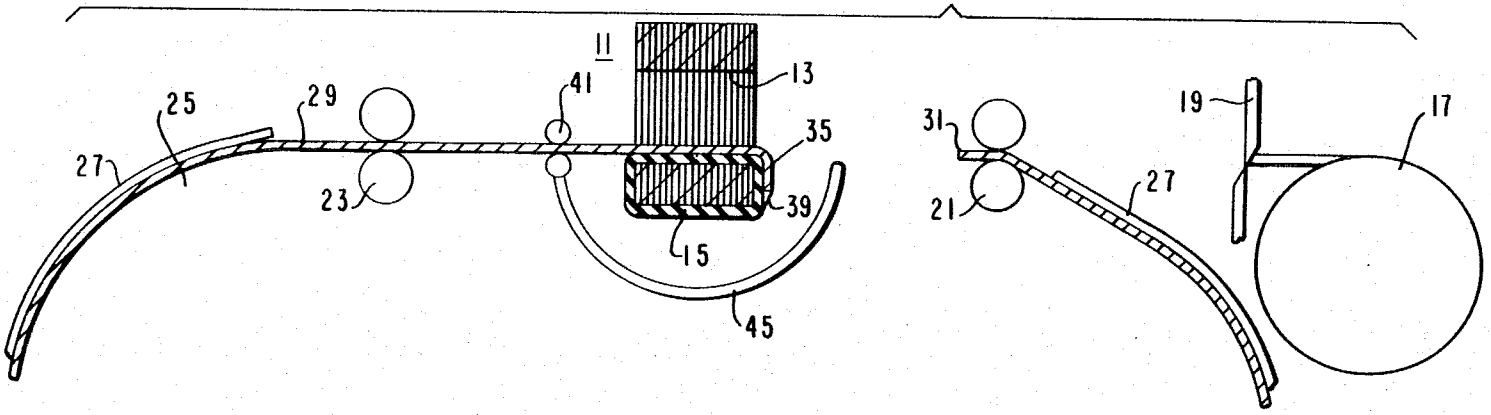

In FIG. 3 a lead or crimped terminal 39 is attached to the tail-end portion 35 of the strip which is then bent down and secured to the core or the winding 15 in a suitable manner such as by taping.

Figure 4:
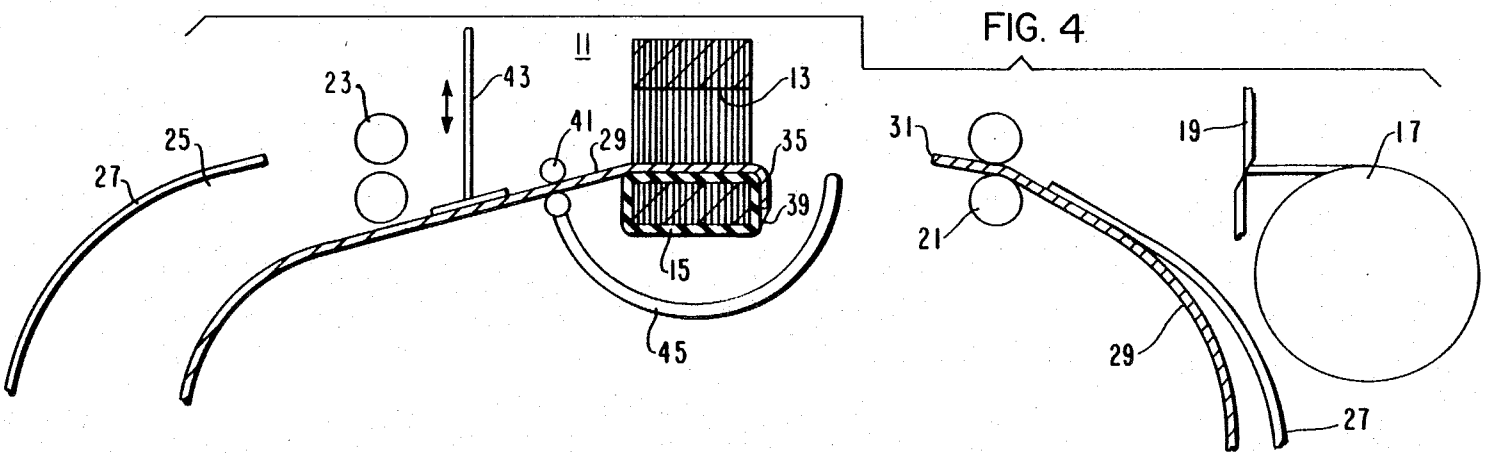

In FIG. 4 a pair of winding or wrapping rolls 41 move into position on either side of the strip 29 from a retracted position either above or below the path of travel of the strip on the left side of the core 11. Simultaneously, the drive rolls 23 retract to a position either above or below the path of travel of the strip and pushing means, such as a ram 43, move against the strip 29 to move it out of the path of alignment with the rolls 23. As the ram 43 retracts from the strip 29 and the drive rolls 23 return to the extended position, the wrapping rolls 41 move counterclockwise in a path or track 45 by suitable means such as being mounted on a shaft extending through a slot in the table surface.

Figure 5:
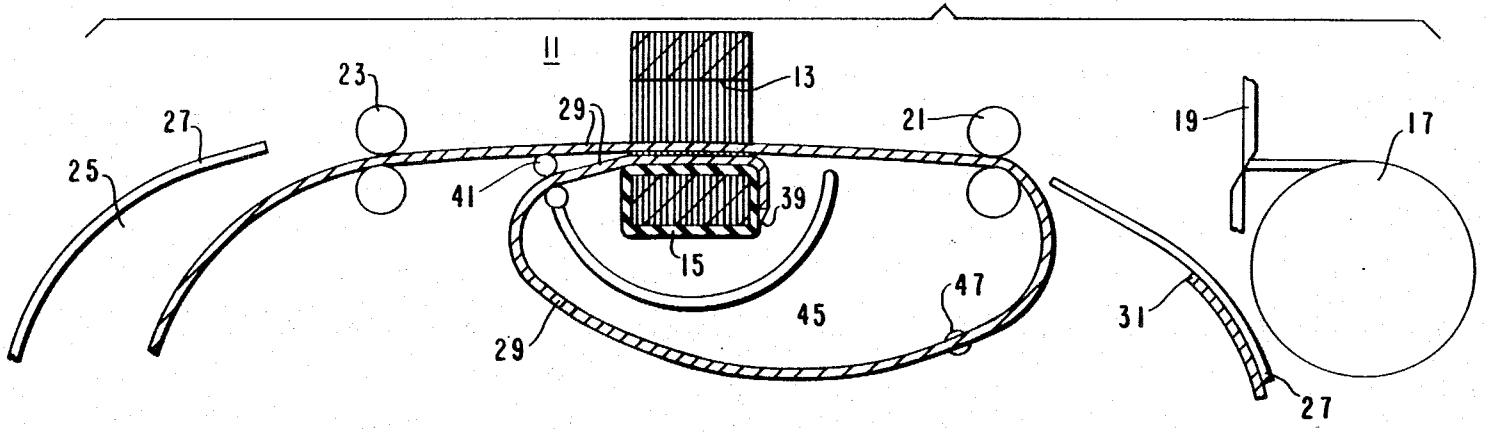

In FIG. 5 the feed rolls 21 move the lead end 31 of the strip through the window 13 to the drive rolls 23 which, in synchronization with the rolls 21, send the lead end 31 around the periphery of the table against the guide means or flange 27 until the strip 29 passes over the beam of an electric eye 47 which then actuates the wrapping rolls 41 to move in the path or track 45 and cause the feed rolls 21 to retract out of place to release the strips 29.

Figure 6:
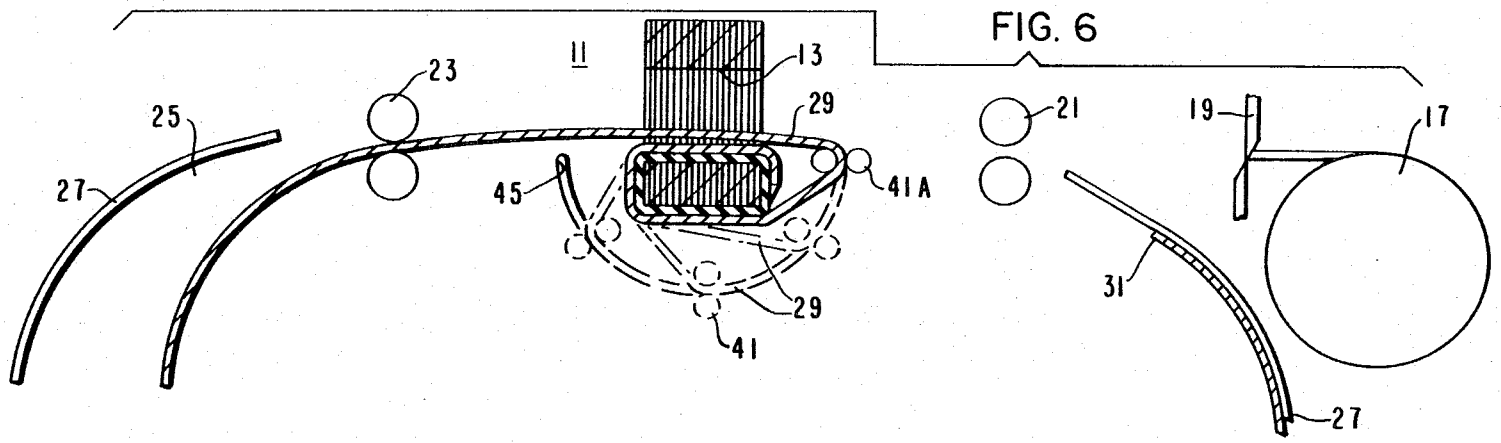

As shown in FIG. 6 the rolls 41 are driven around the fixed track 45 which is located in the working surface of the table 25 and are free to pivot around the mounting shaft extending through the slot of the path 45. The rolls apply a breaking action to the portion of strip 29 being wrapped around the core 11 or winding 15 until the rolls reach the position 41A, where the strip 29 is held tightly in place against the coil 15.

Figure 7:
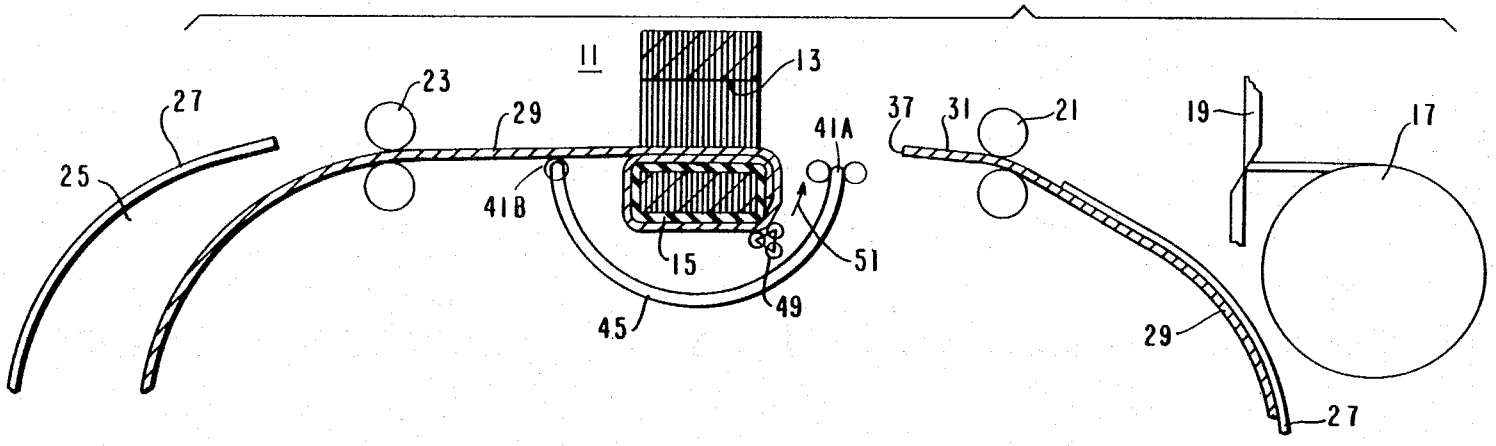

As shown in FIG. 7 when the rolls 41 reach the position 41A, a set of clamping rolls 49 move into position from a retracted position, such as from above the core 11, and clamp the strip 29 in place against the coil 15, or against the core 11 when no coil 15 is preliminarily applied. The rolls 49 rotate around the core to clamp or "iron" the coil surface tightly against the under surface (either coil 15 or core 11) and move around the corner in the direction of the arrow 51. In the meantime, the rolls 41 retract from the table to release the strip 29 and return in the track 45 to their original retracted position at 41B (FIG. 7). In that position, the drive rolls 23 pull the excess material through the core window 13, causing the lead end 31 to move toward the feed rolls 21 and then to the location 37 for a temporary pause.

Meanwhile, the rolls 41 extend from retracted position 41B into alignment in contact with the strip 29 (FIG. 7) and the rolls 23 retract from the strip. Then, as set forth above with respect to FIG. 4, the ram 43 moves against the strip 29 to move it with the rolls 41 to a lower position from where the rolls again move counterclockwise in the path 45 to wrap the strip 29 around the previous turn of trip in a manner similar to that set forth above with respect to FIG. 6.

Figure 8:
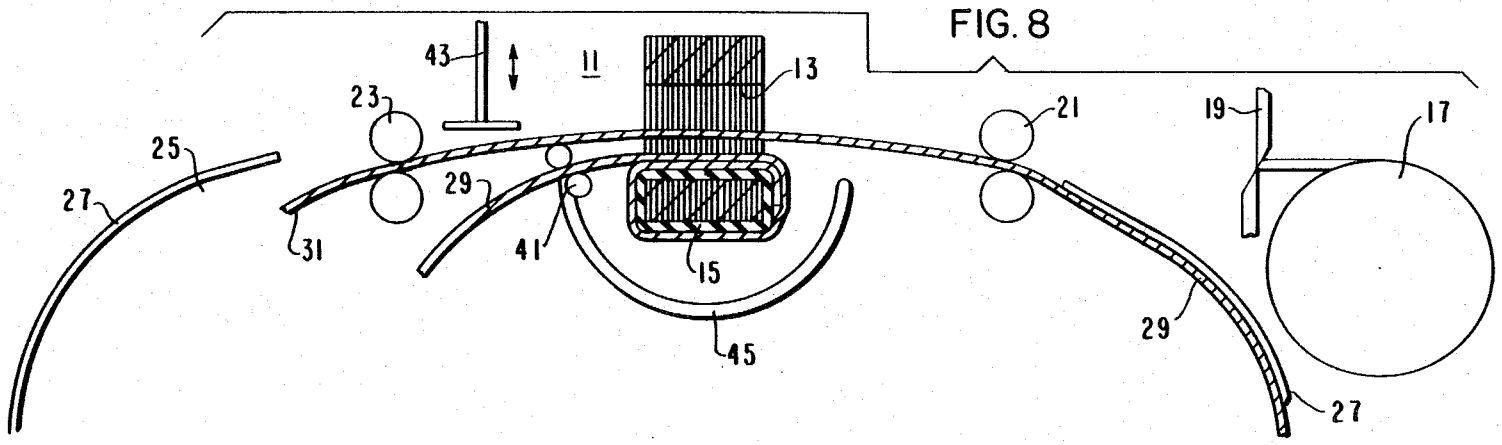

At the same time, the drive rolls 23 return to their operating position (FIG. 8) and the feed rolls 21 extend the strip from the location 37 (FIG. 7) through the core window 13 and to the drive rolls 23, which then drive the lead end 31 of the strip around the table as guided by the flange 27. Thereafter, the steps shown in FIGS. 5, 6 and 7 are repeated until the strip 29 is wound completely around the core 11 and the lead end 31 is attached to the round coil in a suitable manner, such as by a tape, as explained for the tail end at lead 39 (FIG. 4).

Figure 9:
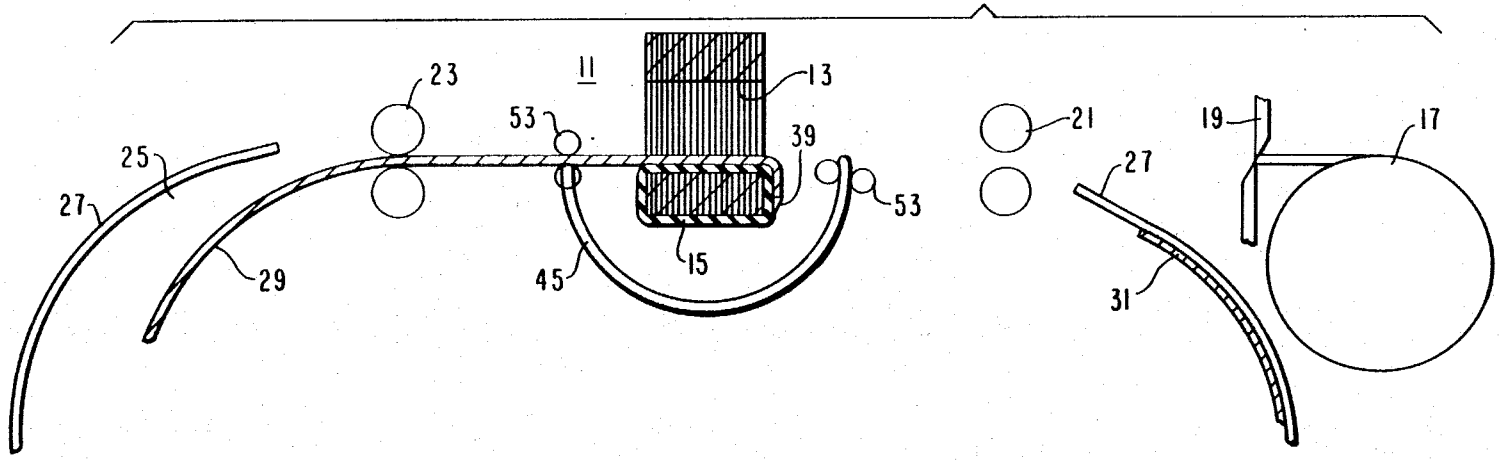
FIG. 9 is a schematic view of another embodiment of the invention.

Another embodiment of the invention is shown in FIG. 9 in which similar numbers refer to similar parts for simplicity of description. More particularly, a pair of winding rolls 53 are disposed in alignment with the strip 29 and with the drive rolls 23. As the lead end 31 of the strip 29 moves to the left out of the core window 13, it passes through the rolls 53 before entering the drive rolls 23. After a sufficient length of strip 29 has moved through the drive rolls 23, the rolls retract from position, whereby the winding or wrapping rolls 53 are free to move in the counterclockwise path 45 as described above. Unlike the rolls 41, the rolls 53 are already in engagement with the strip and are free to move through the path 45 without use of a ram 43, as set forth in the embodiment described with respect to FIGS. 1–8.

Figure 10:
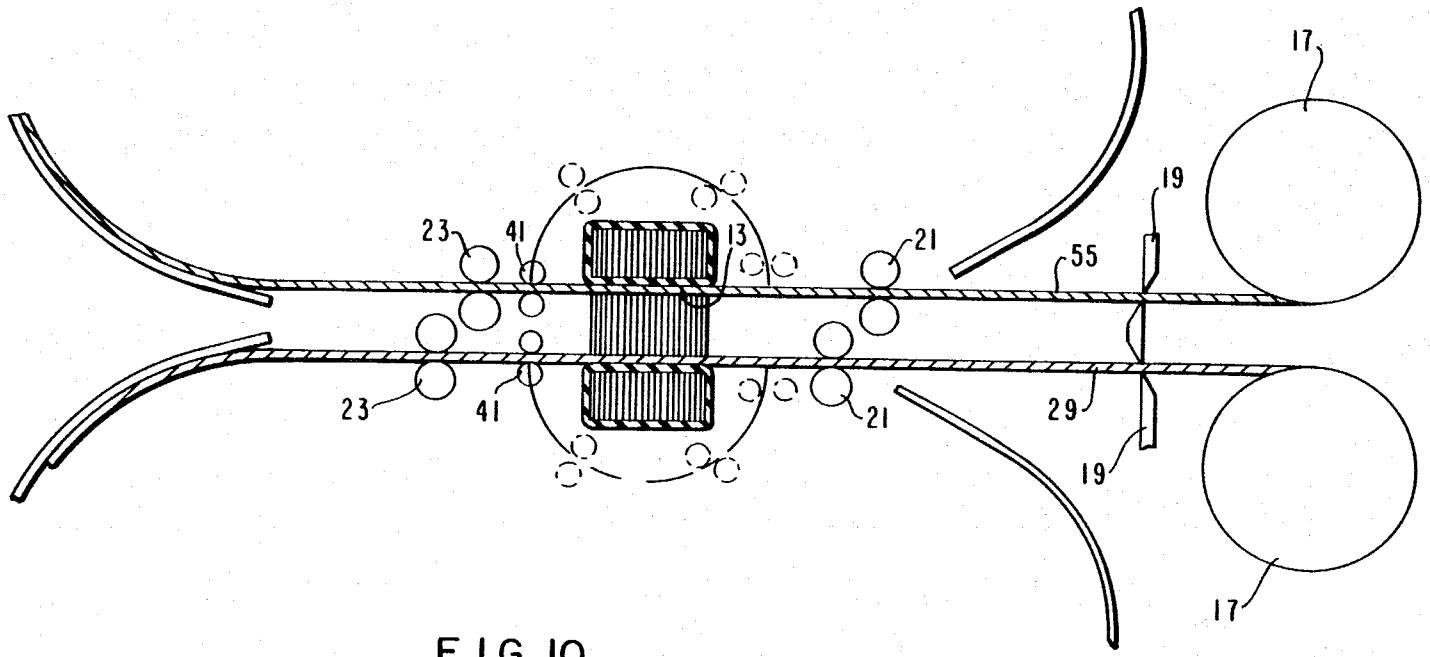
FIG. 10 is a schematic view of the apparatus for winding strip coil on both legs of a core simultaneously.

Although in the embodiments of FIGS. 1–9 one leg of the core was wrapped, it is understood that both legs may be wrapped at the same time by using comparable apparatus to that explained above whereby two strips 29, 55 (FIG. 10) are wrapped simultaneously around both legs of the core 11 by providing a mirror image of the structure shown in FIGS. 1–9.

In conclusion, the apparatus and method of this invention provide for the winding of strip conductor turns to provide coils on a jointless core of a transformer.

What is claimed is:

1. Apparatus for winding a conductive strip around the leg of a magnetic core for making a core-coil assembly, comprising:

means for dispensing conductive strip;

means for feeding the conductive strip through a window of a magnetic core, the window having entrance and exit sides for the strip;

means for shearing the strip to a desired length of strip having lead and tail end portions;

means for directing the lead end portion of the strip back to the entrance side of the core window, for refeeding the lead end portion of the strip therethrough;

means for securing the tail-end portion of the strip to the core;

means at the exit side of the window for holding the strip and for wrapping the strip tautly around the core back to the entrance side, with said means including a pair of winding rolls mounted for reciprocal movement between the entrance and exit sides of the core window; and means for clamping the wrapped strip tightly against the core upon retroaction of the winding rolls from the entrance side to the exit side of the window.

2. The apparatus of claim 1 in which the means for clamping the wrapped strip comprise rolls for rolling engagement and retention of the strip against the core when the winding rolls are retracted from the strip.

* * * * *